US005664263A

United States Patent [19]

Reynolds

[11] Patent Number: 5,664,263

[45] Date of Patent: Sep. 9, 1997

[54] SOCK WITH CONCEALED STORAGE COMPARTMENT

[76] Inventor: Irene Reynolds, 1804 Mountain Rd., Glen Allen, Va. 23060-2235

[21] Appl. No.: 692,373

[22] Filed: Aug. 5, 1996

[51] Int. Cl.[6] ..... A41B 11/00

[52] U.S. Cl. ..... 2/239; 2/247

[58] Field of Search ..... 2/239, 242, 247; 66/178 R, 171, 183, 188, 196, 197

[56] References Cited

U.S. PATENT DOCUMENTS

| | | | |
|---|---|---|---|
| 338,341 | 3/1886 | Dodge | 2/239 X |
| 767,381 | 8/1904 | Brown | 2/239 |
| 1,025,643 | 5/1912 | Presmont | 2/239 |
| 1,117,591 | 11/1914 | Morningstar | 2/239 |
| 1,128,941 | 2/1915 | Brown | 2/247 X |
| 3,796,067 | 3/1974 | East | 66/178 R |
| 3,995,322 | 12/1976 | Chesebro | 2/239 |
| 4,038,699 | 8/1977 | Burn | 2/239 |
| 4,422,307 | 12/1983 | Thorneburg | 2/239 X |
| 4,445,233 | 5/1984 | Rubin | 2/239 |
| 4,961,235 | 10/1990 | Williger | 2/239 |
| 5,027,440 | 7/1991 | Morris | 2/239 |
| 5,133,091 | 7/1992 | Mas | 2/239 |
| 5,157,791 | 10/1992 | Woodson | 2/239 |
| 5,226,194 | 7/1993 | Staley | 2/239 |
| 5,566,396 | 10/1996 | Leib | 2/240 X |

*Primary Examiner*—C. D. Crowder
*Assistant Examiner*—Shirra L. Jenkins
*Attorney, Agent, or Firm*—Norman B. Rainer

[57] ABSTRACT

A knitted sock of mid-calf height has a concealed pocket for the storage of small items. The pocket is formed by attachment of a tubular sleeve to the interior of the leg portion of the sock, and is accessible by way of a zippered closure concealed between adjacent vertical pleats.

14 Claims, 1 Drawing Sheet

SOCK WITH CONCEALED STORAGE COMPARTMENT

BACKGROUND OF THE INVENTION

1. Field of the Invention

The present invention relates to a sock having a concealed pocket for storage of small items.

2. Description of the Prior Art

When jogging or exercising, people tend to wear athletic clothing such as shorts and tee-shirts, which are generally not provided with practical pockets. When jogging through a park, for example, a person would want to carry his house keys with him, and in a public gym, a person may be hesitant to leave keys or valuables in a locker. Even if shorts are provided with pockets, the normal motions of a person jogging or exercising are likely to cause keys, coins, or a wallet to fall out of the pocket and become lost.

There may also be many other times a sock with a pocket may be convenient, and the invention is not limited to any particular use. For example, the sock of the present invention could be used under ordinary clothing to conceal valuables, much as one would wear a money belt.

A list of prior patents which concern pockets in socks is cited as follows:

| U.S. Pat. No. | Patentee(s) | Issue Date |
|---|---|---|
| 4,005,494 | Burn | 02/01/77 |
| 4,038,699 | Burn | 08/02/77 |
| 4,428,080 | Takamatsu | 01/31/84 |
| 4,445,233 | Rubin | 05/01/84 |
| 4,498,200 | Livingstone | 02/12/85 |
| 4,961,235 | Williger | 10/09/90 |
| 5,027,440 | Morris et. al. | 07/02/91 |
| 5,133,091 | Mas | 07/28/92 |
| 5,157,791 | Woodson et. al. | 10/27/92 |

Frequently, the pocket is either formed with or stitched inside the hosiery or sock. There is an opening, in the form of a slit, for example, in the sock which communicates into the pocket, and the opening is closed by an appropriate closure, such as laces, a zipper, a snap fastening, etc.

Hosiery typically is of stretchable material. When a pocket is attached inside a sock, it is often stitched to the sock around at least some margins of the pocket. This may be aesthetically displeasing. Also, the stitching of the substantially less stretchable pocket to the stretchable sock may interfere with the normal stretching of the sock in the vicinity of the pocket which occurs during wearing, and may perhaps lead to tearing of the sock at the stitching, tearing of the pocket or deforming of the stretched sock in the vicinity of the stitching.

In general, socks having a concealable pocket, pouch or compartment at the uppermost, calf portion of the sock involve specialized constructions which result in considerable manufacturing cost, or discomfort during use, or manipulative difficulty of utilization.

It is accordingly an object of the present invention to provide a stretchable sock of knitted construction having a calf portion containing a concealed pocket.

It is another object of this invention to provide a sock as in the foregoing object wherein the pocket does not cause discomfort to the user or deformation of the sock.

It is a further object of the present invention to provide a sock of the aforesaid nature wherein said pocket is large enough to hold sizable objects.

It is a still further object of this invention to provide a sock of the aforesaid nature wherein said pocket and objects therein are easily accessible.

It is yet another object of the present invention to provide sock of the aforesaid nature of durable construction amenable to low cost manufacture.

These objects and other objects and advantages of the invention will be apparent from the following description.

SUMMARY OF THE INVENTION

The above and other beneficial objects and advantages are accomplished in accordance with the present invention by a sock of knitted construction having a foot portion and tubular leg portion stretchable laterally and extending to an upper extremity of mid-calf height, said sock further characterized in having interior and exterior surfaces and a construction enabling it to lie in flat form when not in use, said flat form defining opposite sides of the sock, said tubular portion comprising:

a) an upper contractively tensioned encircling band adjacent said upper extremity, b) a lower contractively tensioned encircling band located adjacent said foot portion, c) a zone of vertical pleats extending between said upper and lower bands, d) an elongated opening disposed between two adjacent pleats within said vertical zone, e) a closure device associated with said elongated opening, and f) an internal tubular sleeve of laterally expandable knitted construction disposed in association with said interior surface within said vertical zone and sewn to said leg portion by upper and lower circumferential lines of a running stitch, and by a vertical sewn line diametrically opposite said elongated opening.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
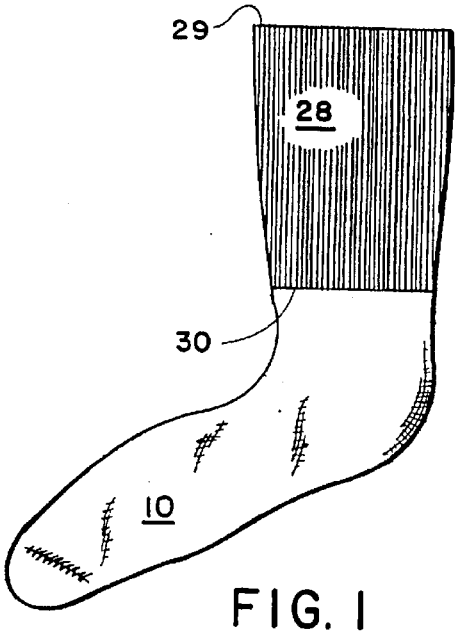
FIG. 1 is a side view of an embodiment of the sock of the present invention.
Figure 2:
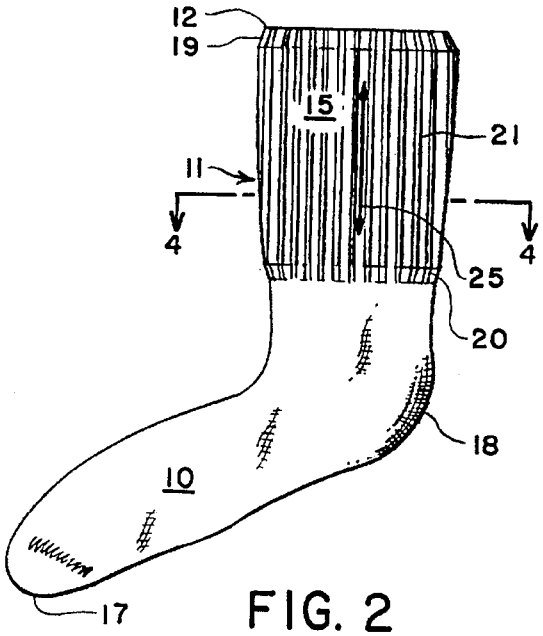
FIG. 2 is a side view of the embodiment of the sock of FIG. 1 in its inverted state.
Figure 3:
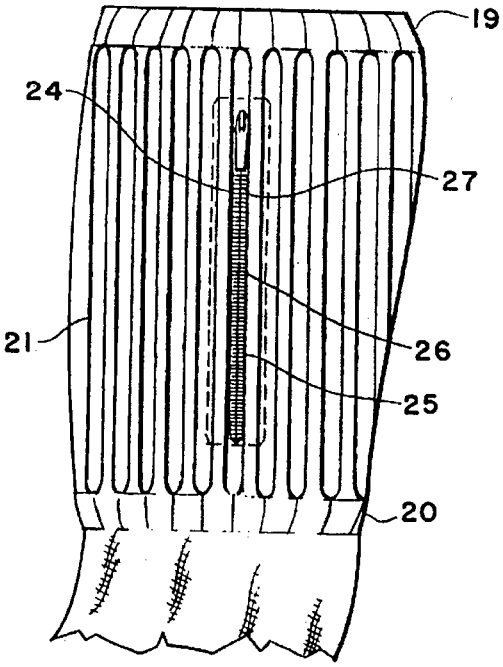
FIG. 3 is an enlarged fragmentary view of the sock of FIG. 1.
Figure 4:
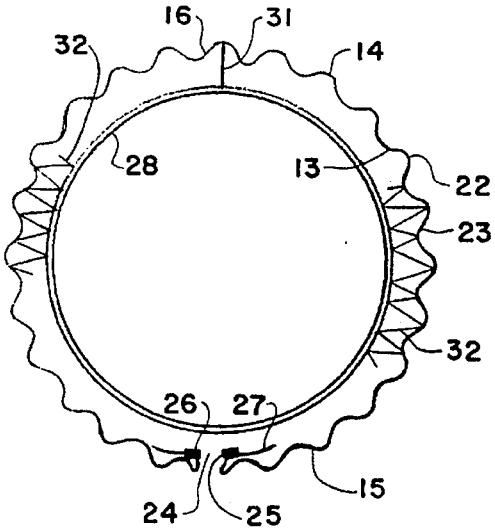
FIG. 4 is an enlarged sectional view taken in the direction of the arrows upon the line 4—4 of FIG. 1.

Referring now to FIGS. 1–4, an embodiment of the sock of the present invention is shown comprised of foot portion 10 and tubular leg portion 11 which extends to upper extremity 12 of mid-calf height. The sock is further characterized in having interior and exterior surfaces 13 and 14, respectively, and a construction which enables the sock to lie in a flat form when not being worn, said flat form defining inside and outside sides 15 and 16, respectively.

The entire sock is of integral knitted construction, said leg portion being stretchable laterally, namely in a direction transverse to the direction of elongation of said tubular leg portion. Foot portion 10 extends in length between toe extremity 17 and heel section 18. The expression "mid-calf height" is intended to denote socks wherein the length of the leg portion is between 1.0 and 1.3 times the length of the foot portion.

Leg portion 11 has an upper contractively tensioned encircling band 19 adjacent upper extremity 12, and a lower contractively tensioned encircling band 20 located adjacent said foot portion. The nature of the contractive tensioning is preferably such as may be obtainable by a ribbing modification of the knitted construction which otherwise characterizes said tubular leg portion. However, the tensioning may also be achieved by the incorporation of elastomeric fibers into the knitted construction. The heights of bands 19 and 20 may range between about one and two inches.

A zone of vertical pleats 21 extends between said upper and lower bands. The height of the pleats, measured between the peak 22 of one pleat to the adjacent valley 23 between contiguous pleats, will range between about ⅛" and ¼" in the flat, storage state of the sock.

An elongated opening 24 is disposed in a valley 23 on the inside side 15 of the sock, said opening being formed by way of a modification of the knitting pattern, and not by way of cutting. A closure device, preferably a zipper 25 is sewn to the opposed edges of opening 24. The zipper is preferably of very compliant construction, having a series of small plastic teeth 26 spaced apart about 1 mm. The teeth and the fabric backing 27 of the zipper have a color which matches the color of the sock, the preferable color being white. The compliant nature of the zipper enables the leg portion to be turned downwardly, producing a bobby-sock style of lower calf length.

An internal tubular sleeve 28 of laterally expandable knitted construction is disposed in flush facing relationship with interior surface 13 within the vertical zone of pleats 21. Sleeve 28 is sewn to said leg portion by upper and lower circumferential stitch lines 29 and 30, respectively, and by vertically sewn stitch line 31 diametrically opposite elongated opening 24. Said stitch lines 29 and 30 are comprised of a running stitch. The expression "running stitch" is intended to denote a V-shaped continuously advancing thread path that interweaves two adjacent fabric pieces, said path having no back tracking for interlocking purposes. As a consequence of the use of the running stitch, internal sleeve 28 can expand laterally to the same extent as leg portion 11, particularly at stitch lines 29 and 30.

The interaction of the sleeve 28 with the interior surface of said leg portion creates a pocket 32. The primary function of vertical stitch line 31 is to divide the pocket into two compartments, thereby preventing items stored in the pocket from rotating about the pocket. The vertical stitch line also prevents sagging of the pocket or the leg portion.

In the marketing of the sock of this invention, the sock will be one sock of a pair of socks, the other sock in the pair being of similar construction as the pocket-containing sock but without the zipper. It is intended that the pocket-containing sock of this invention be worn in a manner such that the zippered entrance to the pocket be disposed upon the inside side of the sock, namely in facing relationship to the other sock. In such manner of use, the presence of the zipper is even further obscured from view.

While particular examples of the present invention have been shown and described, it is apparent that changes and modifications may be made therein without departing from the invention in its broadest aspects. The aim of the appended claims, therefore is to cover all such changes and modifications as fall within the true spirit and scope of the invention.

Having thus described my invention, what is claimed is:

1. A sock of knitted construction having a foot portion and tubular leg portion stretchable laterally and extending to an upper extremity of mid-calf height, said sock further characterized in having interior and exterior surfaces and a construction enabling it to lie in flat form when not in use, said flat form defining inside and outside sides of the sock, said tubular portion comprising:

a) an upper contractively tensioned encircling band adjacent said upper extremity, b) a lower contractively tensioned encircling band located adjacent said foot portion, c) a zone of vertical pleats extending between said upper and lower bands, d) an elongated opening disposed between two adjacent pleats within said vertical zone, e) a closure device associated with said elongated opening, and f) an internal tubular sleeve of laterally expandable knitted construction disposed in association with said interior surface within said vertical zone and sewn to said leg portion by upper and lower circumferential lines of a running stitch, and by a vertical sewn line diametrically opposite said elongated opening, whereby g) a pocket is created by the interaction of said sleeve with the interior surface of said leg portion.

2. The sock of claim 1 wherein the length of the leg portion is between 1.0 and 1.3 times the length of the foot portion.

3. The sock of claim 1 wherein said contractive tensioning results from a ribbing modification of the knitted construction which otherwise characterizes said tubular leg portion.

4. The sock of claim 3 wherein said contractive tensioning is further resultant from the incorporation of elastomeric fibers into the knitted construction.

5. The sock of claim 1 wherein the heights of said upper and lower encircling bands is between one and two inches.

6. The sock of claim 5 wherein said pleats are characterized in having successive peaks and valleys.

7. The sock of claim 6 wherein the height of said pleats, measured between the peak of one pleat and the adjacent valley between contiguous pleats ranges between ⅛" and ¼" in the flat, storage state of the sock.

8. The sock of claim 7 wherein said elongated opening is disposed upon the inside side of the sock.

9. The sock of claim 8 wherein said elongated opening is formed by way of a modification of the knitting pattern.

10. The sock of claim 9 wherein said closure device is a zipper having an associated fabric backing that is sewn to the opposed edges of said elongated opening.

11. The sock of claim 10 wherein said zipper is of compliant construction, having a series of small plastic teeth spaced about 1 mm. apart.

12. The sock of claim 11 wherein the teeth and fabric backing of said zipper have a color that matches the color of the sock.

13. The sock of claim 9 wherein said vertical stitch line divides said pocket into two compartments.

14. A pair of socks of knitted construction, one member of said pair being the sock of claim 1.

* * * * *